US011326856B2

(12) United States Patent
De La Nuez

(10) Patent No.: US 11,326,856 B2
(45) Date of Patent: May 10, 2022

(54) GUN SAFETY STORAGE SYSTEM

(71) Applicant: Nelson R. De La Nuez, Orlando, FL (US)

(72) Inventor: Nelson R. De La Nuez, Orlando, FL (US)

( * ) Notice: Subject to any disclaimer, the term of this patent is extended or adjusted under 35 U.S.C. 154(b) by 117 days.

(21) Appl. No.: 16/695,039

(22) Filed: Nov. 25, 2019

(65) Prior Publication Data

US 2020/0370865 A1 Nov. 26, 2020

Related U.S. Application Data

(63) Continuation-in-part of application No. 16/417,556, filed on May 20, 2019.

(51) Int. Cl.

| | |
|---|---|
| ***F41C 33/06*** | (2006.01) |
| ***A45C 13/18*** | (2006.01) |
| ***A45C 3/00*** | (2006.01) |

(52) U.S. Cl.

CPC ..... *F41C 33/06* (2013.01); *A45C 3/001* (2013.01); *A45C 13/18* (2013.01)

(58) Field of Classification Search

CPC ..... F41C 33/06; F41C 33/0209; A45C 3/001; A45C 3/02; A45C 13/18; A45C 13/185; A45C 13/10; A45C 13/005; B60R 25/01; B60R 1/06; B60R 1/12; B32B 2307/581; B60J 11/06; B60J 11/00

See application file for complete search history.

(56) References Cited

U.S. PATENT DOCUMENTS

| | | | | |
|---|---|---|---|---|
| 4,182,386 A * | 1/1980 | Alack | B65G 69/182 141/83 |
| 4,877,131 A * | 10/1989 | Patros | F41C 33/06 206/317 |
| 5,150,476 A * | 9/1992 | Statham | A41D 31/085 2/93 |
| 5,890,452 A * | 4/1999 | Lundeen | A01K 1/0114 119/167 |
| 6,253,915 B1 * | 7/2001 | Mesica | F41C 33/06 206/317 |

(Continued)

FOREIGN PATENT DOCUMENTS

| | | | |
|---|---|---|---|
| CA | 2937933 A1 * | 2/2017 | A45C 11/00 |
| DE | 202013007971 U1 * | 2/2014 | A45C 3/06 |

(Continued)

*Primary Examiner* — J. Gregory Pickett
*Assistant Examiner* — Abigail Elizabeth Guidry
(74) *Attorney, Agent, or Firm* — Olav M. Underdal; IDP Patent Services

(57) ABSTRACT

A safety storage system includes a safety case with case body and a case lid; a lock bag with a bag portion made from a cut-resistant material and a cable guide; and a cable lock, including a lock body, a lock cable, and a key; such that the lock cable protrudes through the cable guide to attach the cable lock to the lock bag; such that the safety case with the handgun inside can be locked inside the lock bag with the cable lock, whereby the handgun is safely stored in the safety storage system. Additionally, the safety storage system can be secured in position with the lock cable attached to a mounting structure with the lock bag closed and the safety case with the handgun inside locked in the interior of the lock bag, thereby preventing access to and theft of the handgun.

17 Claims, 11 Drawing Sheets

(56) References Cited

U.S. PATENT DOCUMENTS 6,332,713 B1 * 12/2001 Cohen ..... A45C 11/20 383/117
6,612,350 B1 * 9/2003 Brynjulfsen ..... A45C 3/001 150/118
7,447,531 B2 * 11/2008 Eswaraiah ..... H04M 1/17 379/449
7,510,080 B2 * 3/2009 Smart ..... A45C 3/00 206/570
7,806,261 B2 * 10/2010 Chang ..... A45C 13/02 206/320
8,528,371 B2 * 9/2013 Spiegel ..... E05B 37/025 70/18
9,038,679 B2 * 5/2015 Marquez-Bottome ..... A45C 13/002 150/103
9,103,627 B1 * 8/2015 Campbell ..... F41C 33/048
9,986,808 B2 * 6/2018 Halpern ..... A45C 13/1046
10,180,303 B2 * 1/2019 Gilbert ..... B65D 43/163
10,258,125 B1 * 4/2019 Cohen ..... B32B 27/306
10,502,524 B1 * 12/2019 Gee ..... F41C 33/06
D876,044 S * 2/2020 Sisco ..... D99/28
11,112,211 B1 * 9/2021 Watson ..... F41C 33/0218
2002/0168919 A1 * 11/2002 Perkins ..... A63H 3/005 446/369
2003/0021501 A1 * 1/2003 Blau ..... G09F 3/08 383/40
2005/0262904 A1 * 12/2005 Ling ..... E05B 67/003 70/49
2007/0131641 A1 * 6/2007 Higgins ..... B65D 41/3428 215/252
2008/0148789 A1 * 6/2008 Wyers ..... E05B 67/003 70/49
2009/0266722 A1 * 10/2009 Rogers ..... B65D 5/643 206/216
2009/0266860 A1 * 10/2009 Schneider Barterian ..... A45C 3/001 224/581
2010/0002962 A1 * 1/2010 Tatsuno ..... A47G 9/086 383/85
2012/0137741 A1 * 6/2012 Yu ..... E05B 67/003 70/53
2012/0152776 A1 * 6/2012 Camp ..... F41C 33/0263 206/317
2014/0111860 A1 * 4/2014 Beam ..... B60J 11/06 359/507
2015/0328968 A1 * 11/2015 Barber ..... G02B 5/08 359/511
2016/0192617 A1 * 7/2016 Murphy ..... A47G 9/0238 119/28.5
2017/0188672 A1 * 7/2017 Ruiz ..... A45C 13/1046
2017/0188675 A1 * 7/2017 Ahmed ..... A45C 13/005
2017/0254137 A1 * 9/2017 Peck ..... E05G 1/005
2017/0321991 A1 * 11/2017 Trinca ..... F41C 33/0218
2018/0037102 A1 * 2/2018 Wade ..... B60J 11/06
2018/0042347 A1 * 2/2018 Schmick, Jr. ..... A45F 3/02
2018/0098606 A1 * 4/2018 Hoying ..... B32B 5/26
2018/0128572 A1 * 5/2018 Carter ..... F41C 33/06
2018/0255893 A1 * 9/2018 Godshaw ..... A45C 3/06
2020/0348102 A1 * 11/2020 Bridgman, Jr. ..... F41C 33/02
2020/0383443 A1 * 12/2020 Shelton ..... A45F 5/02
2021/0123501 A1 * 4/2021 Yu ..... F16G 11/101

FOREIGN PATENT DOCUMENTS

FR 1076765 A * 10/1954 ..... A45C 3/001
GB 2496118 A * 5/2013 ..... A01K 13/008
WO WO-03092429 A2 * 11/2003 ..... B60R 1/06
WO WO-2017018870 A1 * 2/2017 ..... A45F 3/04
WO WO-2019233963 A1 * 12/2019 ..... A45C 3/001

* cited by examiner

Side Mirror Lock System

GUN SAFETY STORAGE SYSTEM

CROSS-REFERENCE TO RELATED APPLICATIONS

This application is a continuation-in-part of U.S. Non-Provisional application Ser. No. 16/417,556, filed May 20, 2019; which is hereby incorporated herein by reference in its entirety.

FIELD OF THE INVENTION

The present invention relates generally to the field of safety related storage systems, and more particularly to methods and systems for safely storing a handgun while having rapid accessibility for personal protection.

BACKGROUND OF THE INVENTION

Safe storage of handguns around the house, particularly in relation to safeguarding children, is a topic of great concern to responsible gunowners.

There are many storage options available for use in the home, but such devices and systems typically do not provide safe options for moving handguns with an option of locking the stored handgun to environmental structures.

As such, considering the foregoing, it may be appreciated that there continues to be a need for novel and improved devices and methods for securing a vehicle rear-view side mirror from theft.

SUMMARY OF THE INVENTION

The foregoing needs are met, to a great extent, by the present invention, wherein in aspects of this invention, enhancements are provided to the existing model of devices and methods for methods and systems for safely storing a handgun.

In an aspect, a safety storage system, can include:

a) a safety case, which can include:
  i. a case body with a front opening and a case interior, which is accessible via the front opening;
    such that the case interior is configured to contain a handgun, such that the handgun can be inserted into the case interior via the front opening; and optionally
  ii. a case lid, which can be hingedly connected on a front of the case body;

b) an antitheft bag, which can include:
  i. a lock bag, which can be made from a cut-resistant material, wherein the lock bag can include:
    1. a bag portion, which comprises an interior, which is configured to contain the safety case; and
    2. a cable guide, which can be mounted to an outer periphery of the bag portion along an opening to the interior of the bag portion, such that the cable guide for example can be:
      a continuous tube (also called a hem or casing); or
      a plurality of reinforced holes in the cut-resistant material or guide segments, which allows a lock cable of a cable lock to be laced through the plurality of holes or guide segments; and
  ii. a cable lock, which can include:
    1. a lock body, which for example can be locked and unlocked with a key or other locking mechanism;
    2. a lock cable, which can be releasably lockable onto the lock body, such that the cable lock and lock cable form a closed loop with a loop opening, when the cable lock is locked; and
    3. a key, which is configured to lock and unlock the lock body, to secure and release the lock cable;
  wherein the lock cable protrudes through the cable guide, such that the cable lock is attached to the lock bag;
  such that the safety case with the handgun inside is positionable in the interior of the bag portion, when the antitheft bag is unlocked, such that the safety case with the handgun inside cannot be removed from the antitheft bag when the antitheft bag is locked;
  such that the safety case with the handgun inside can be locked inside the lock bag with the cable lock, whereby the handgun is safely stored in the safety storage system.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
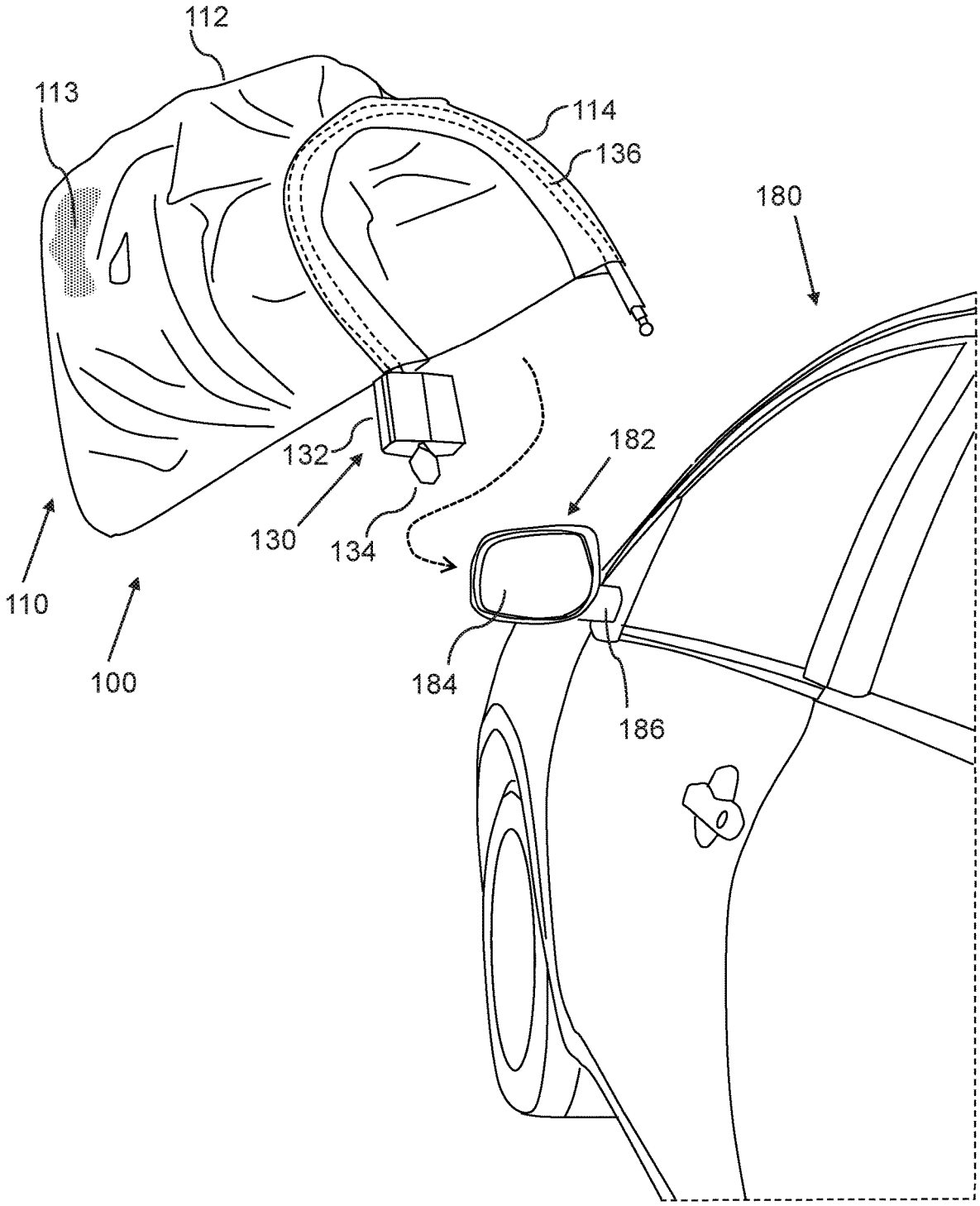
FIG. 1 is a perspective view of a side mirror antitheft device before installation on a side mirror of a vehicle, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a safety storage system 700 with reference to FIG. 7, in such manner that like reference numerals refer to like components throughout; a convention that we shall employ for the remainder of this specification.

Figure 7:
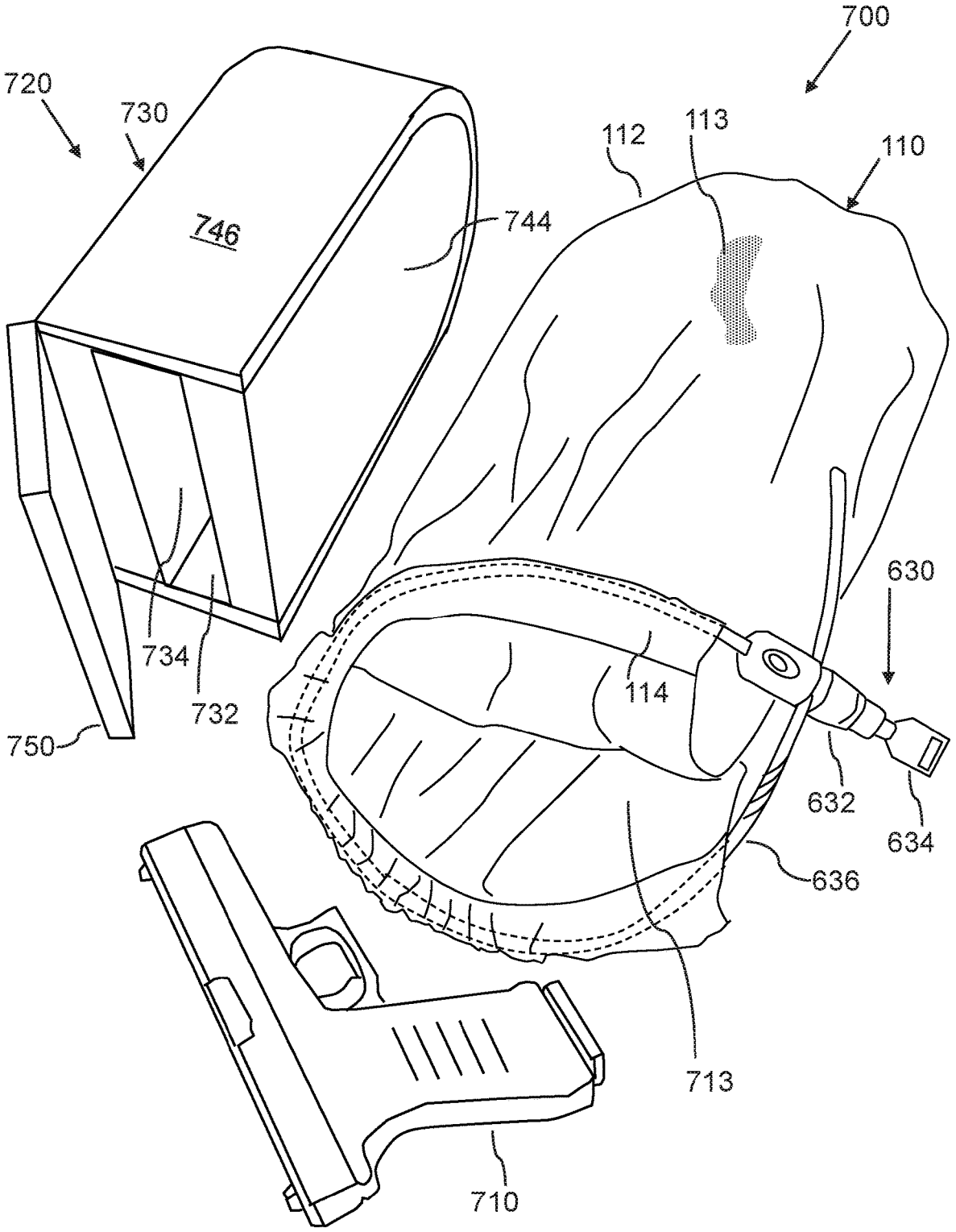
FIG. 7 is a perspective view of a safety storage system in an unlocked configuration, according to an embodiment of the invention.
Figure 8A:
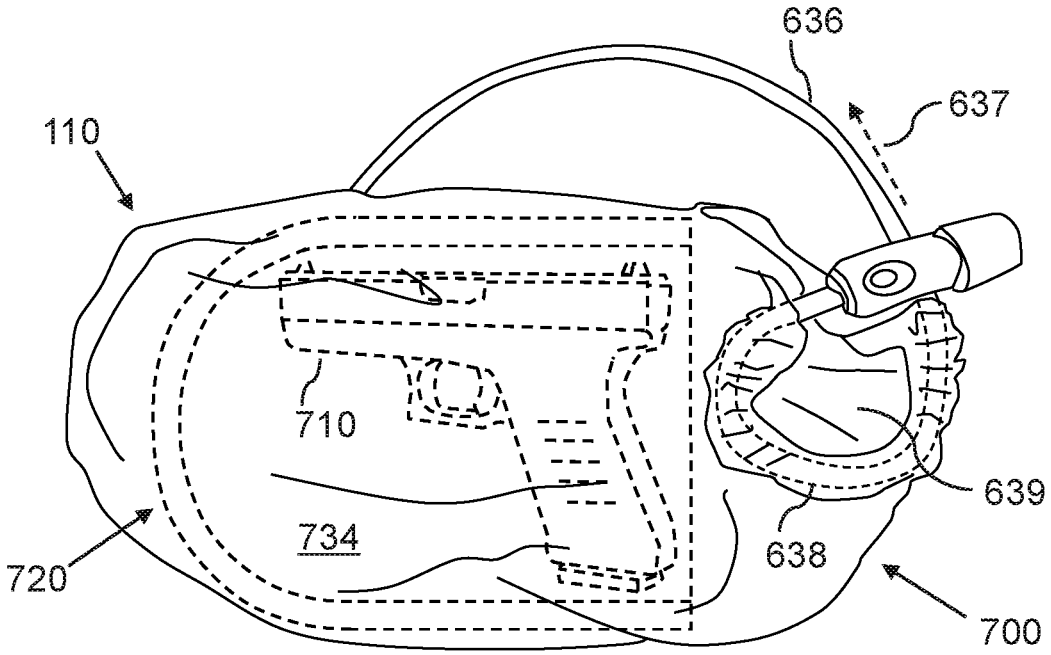
FIG. 8A is a perspective view of a safety storage system in a locked configuration with a handgun positioned inside a safety case, which is in an interior of an antitheft bag, according to an embodiment of the invention.

In an embodiment, as shown in FIG. 7, a safety storage system 700, also called a FLEXIBLE GUN SAFETY HTC PROKEVLOCK BAG™ 700, can include:

a) a handgun 710 (also referred to as a handheld firearm 710);

b) a safety case 720, which can include:

i. a case body 730, including:

1. a front opening 732; and
2. a case interior 734, which is accessible via the front opening 732;

such that the case interior 734 is configured to contain the handgun 710, such that the handgun is insertable into the case interior 734 via the front opening 732; and ii. a case lid 750, which can be hingedly connected on a front of the case body 730, wherein the case lid 750 can be configured to close access to the front opening of the case interior, when the cover is in a closed configuration, and wherein the cover is configured to provide access to the front opening of the case interior, when the cover is in an open configuration;

c) an antitheft bag 100, which can also be called an antitheft device 100, which can include:

i. a lock bag 110, which can be made from a cut-resistant material 113, wherein the lock bag 110 can include:

1. a bag portion 112, which comprises an interior 713, which is configured to contain the safety case 720; and
2. a cable guide 114, which can be mounted to an outer periphery of the bag portion along an opening to the interior of the bag portion 112, such that the cable guide can for example be:

a continuous tube 114 (also called a hem 114 or casing 114; for example, formed by folding and sewing the outer ends of the material used for the bag portion);

a plurality of reinforced holes (such as lined with metal eyelets) in the cut-resistant material 113 or guide segments, which allows a lock cable 636 of a cable lock 630 to be laced through the plurality of holes or guide segments; or or a plurality of loops, which allows a lock cable 636 of a cable lock 630 to be laced through the plurality of loops; and ii. a cable lock 630, which can include:

1. a lock body 632, which for example can be locked and unlocked with a key 634 or other locking mechanism;
2. a lock cable 636, which can be releasably lockable onto the lock body 632, such that the cable lock 630 and lock cable 636 form a closed loop 638 with a closed and minimal loop opening 639, when the cable lock 130 is locked, as shown in FIG. 8A; and
3. a key 634, which is configured to lock and unlock the lock body 632, to secure and release the lock cable 636;

wherein the lock cable 636 protrudes through the cable guide, such that the cable lock 630 is attached to the lock bag 110;

wherein the cable lock 630 can be locked tight on the lock bag 110, such that the lock bag 110 is locked closed, with a minimal bag opening 639, as shown in FIGS. 6C, 6D, 8A, and 8B, thereby preventing removal of an object 670, such as a safety case 720, which has been positioned inside the lock bag 110;

such that the safety case 720 with the handgun 710 inside is positionable in the interior 713 of the bag portion 112, when the antitheft bag 100 is unlocked, such that the safety case 720 with the handgun 710 inside cannot be removed from the antitheft bag 100 when the antitheft bag 100 is locked, because the minimal bag opening 639 is configured to be too small to allow removal of the safety case 720;

such that the safety case with the handgun inside can be locked inside the lock bag 110 with the cable lock 130, whereby the handgun is safely stored in the safety storage system 700.

The safety case thereby provides an additional safety of the handgun 710 by preventing access to a trigger of the handgun 710 or preventing other access to safety features of the handgun 710. Without the safety case 720, a handgun locked directly inside the antitheft bag 100 could potentially be manipulated trough the flexible material of the lock bag 110 and could therefore potentially be fired by indirect touching of the trigger. The bag portion 112 can be configured with a size of the interior 713 of the bag portion 112 (i.e. a snug fit), such that the handgun 710 cannot be removed from the safety case 720, when the safety case 720 with the handgun 710 inside is locked inside the antitheft bag 100. The case lid 750 can further prevent access to or removal of the handgun, as the bag portion 112 can be configured with a size of the interior 713 of the bag portion 112 (i.e. a snug fit), such that the case lid 750 cannot be opened, when the safety case 720 with the handgun 710 inside is locked inside the antitheft bag 100.

In a related embodiment, FIG. 8A shows a locked configuration of the safety storage system 700 with the handgun 710 inside the safety case 720, which is locked inside the antitheft bag 100. The handgun 710 and the safety case 720 are here shown in dotted lines to indicate they are inside the antitheft bag 100.

Figure 8B:
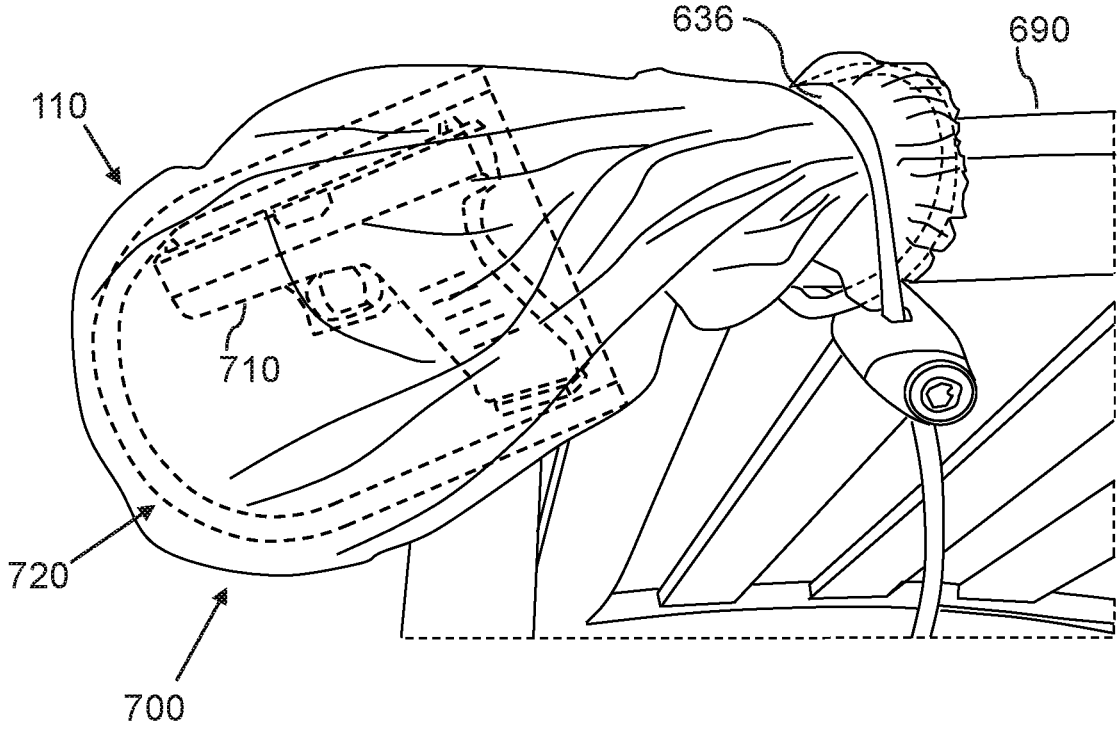
FIG. 8B is a perspective view of a safety storage system in a locked configuration and attached to a mounting structure, with a handgun positioned inside a safety case, which is in an interior of an antitheft bag, according to an embodiment of the invention.

In another related embodiment, FIG. 8B shows a locked configuration of the safety storage system 700 with the handgun 710 inside the safety case 720, which is locked inside the antitheft bag 100, such that the antitheft bag 100 has been locked in place on a mounting structure 690, here shown as a back of a chair 690, thereby preventing access to and theft of the handgun 710.

In yet a related embodiment, as shown in FIGS. 1, 9A, 9B, 9C, 10A, and 10B the case body 730, can include:

a) a top wall 942;

b) a bottom wall 744; and c) a side wall 746, which is curved in a u-shape, such that the top wall 942 is connected to an upper inside of the u-side wall 746 (i.e. the top wall 942 is mounted in an upper inside of the u-shape) and the bottom wall 744 is connected to a lower inside of the side wall 746 (i.e. the bottom wall 744 is mounted in a lower inside of the u-shape);

such that a case interior 734 with a front opening 732 is formed between the top and bottom walls 942, 744 and the side wall 746, such that the front opening 732 provides access to the case interior 734;

wherein the top and bottom walls 942, 744 for example can be glued or heat-welded to the side wall 746.

In a related embodiment, the top wall 942, the bottom wall 744, the side wall 746, and the case lid 750 can be made from a foam material, such as a polyethylene foam, which for example can be 2.2 pounds per cubic feet polyethylene foam material.

Figure 9A:
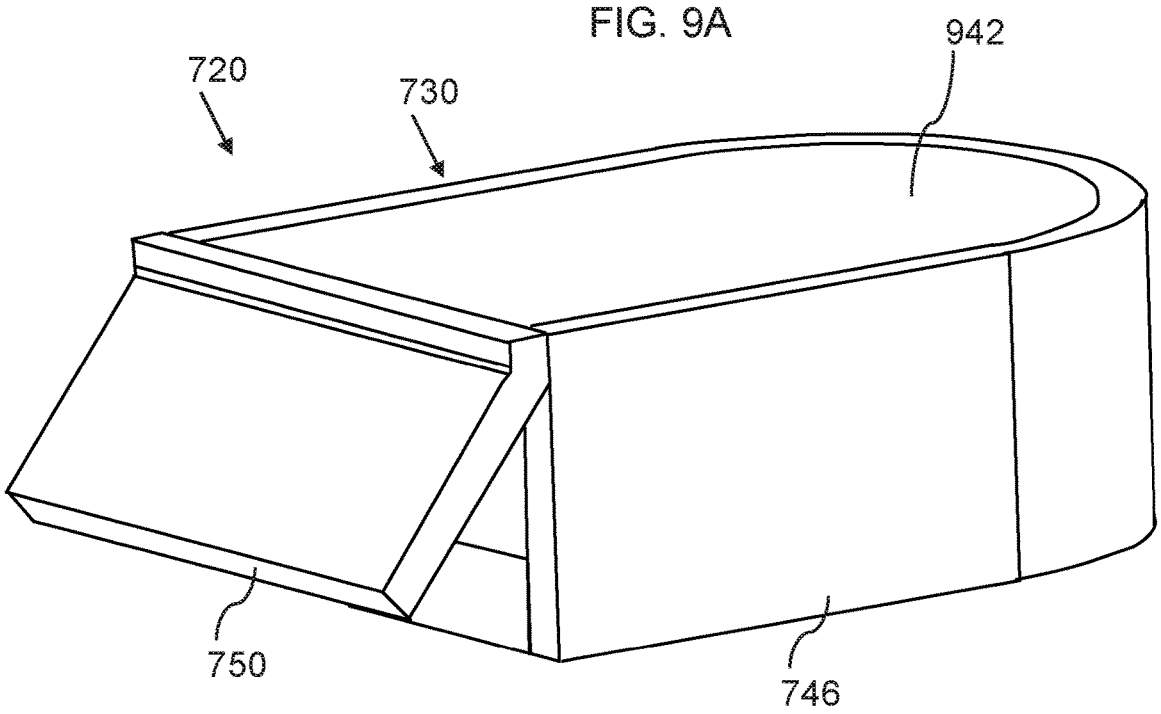
FIG. 9A is a side perspective view of a safety case of a safety storage system, according to an embodiment of the invention.
Figure 9B:
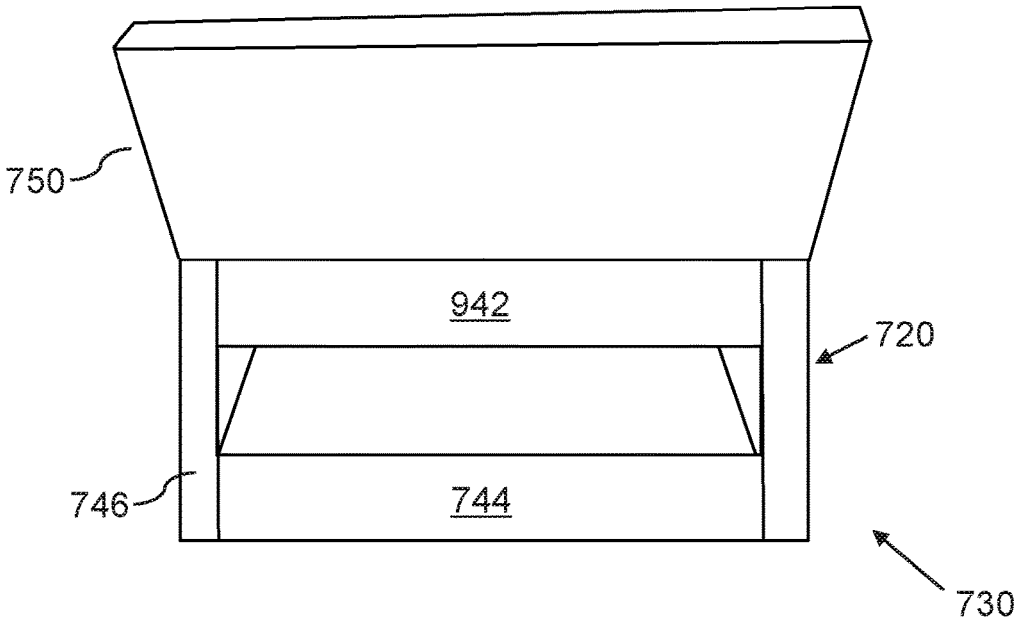
FIG. 9B is a front perspective view of a safety case of a safety storage system, according to an embodiment of the invention.
Figure 9C:
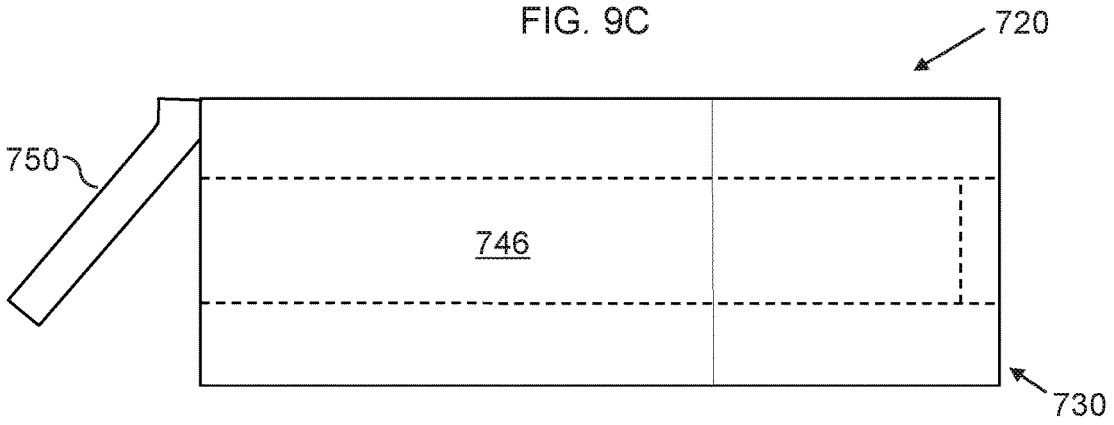
FIG. 9C is a side view of a safety case of a safety storage system, according to an embodiment of the invention.
Figure 10A:
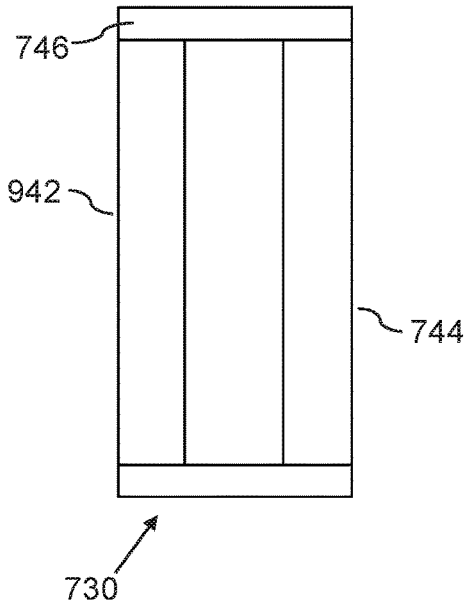
FIG. 10A is a front view of a case body of a safety storage system, according to an embodiment of the invention.
Figure 10B:
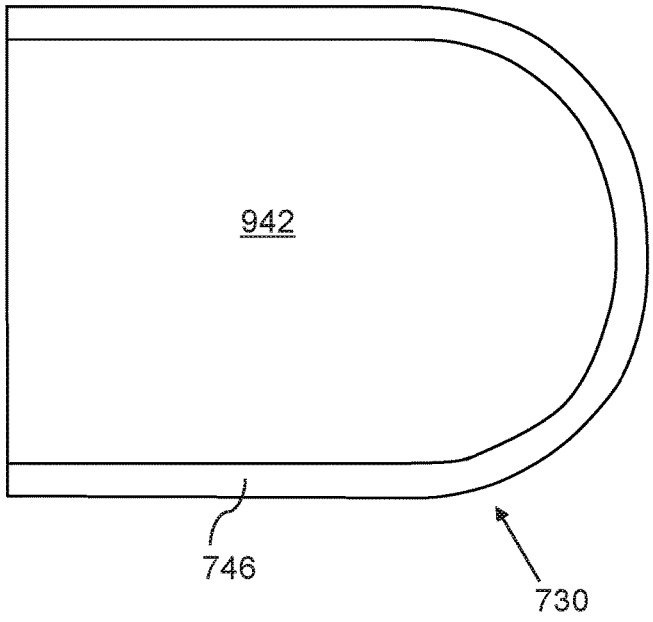
FIG. 10B is a top view of a case body of a safety storage system, according to an embodiment of the invention.

In a related embodiment, as shown in FIGS. 9A and 9B the case lid 750 can be made from a flexible material, such as a flexible foam material, such that an upper part of the case lid 750 can be connected (such as glued or heat-welded) to an upper part of a front of the case body 730, such that the case lid 750 is configured as a flapper lid 750, with a flexible hinge.

Thus, in another embodiment, as shown in FIG. 7, a safety storage system 700 can include:

a) a safety case 720, which can include:

i. a case body 730, including:

1. a front opening 732; and 2. a case interior 734, which is accessible via the front opening 732;

such that the case interior 734 is configured to contain the handgun 710, such that the handgun is insertable into the case interior 734 via the front opening 732; and ii. a case lid 750, which can be hingedly connected on a front of the case body 730, wherein the case lid 750 can be configured to close access to the front opening of the case interior, when the cover is in a closed configuration, and wherein the cover is configured to provide access to the front opening of the case interior, when the cover is in an open configuration;

b) an antitheft bag 100, which can also be called an antitheft device 100, which can include:

i. a lock bag 110, which can be made from a cut-resistant material 113, wherein the lock bag 110 can include:

1. a bag portion 112, which comprises an interior 713, which is configured to contain the safety case 720; and ii. a bag lock 630, which for example can be locked and unlocked with a key 634 or other locking mechanism;

wherein the bag lock 630 can be locked tight on the lock bag 110, such that the lock bag 110 is locked closed, with a minimal bag opening 639, as shown in FIGS. 6C, 6D, 8A, and 8B, thereby preventing removal of an object 670, such as a safety case 720, which has been positioned inside the lock bag 110;

such that the safety case 720 with the handgun 710 inside is positionable in the interior 713 of the bag portion 112, when the antitheft bag 100 is unlocked, such that the safety case 720 with the handgun 710 inside cannot be removed from the antitheft bag 100 when the antitheft bag 100 is locked, because the minimal bag opening 639 is configured to be too small to allow removal of the safety case 720;

such that the safety case with the handgun inside can be locked inside the lock bag 110 with the bag lock 630, whereby the handgun is safely stored in the safety storage system 700.

Figure 2:
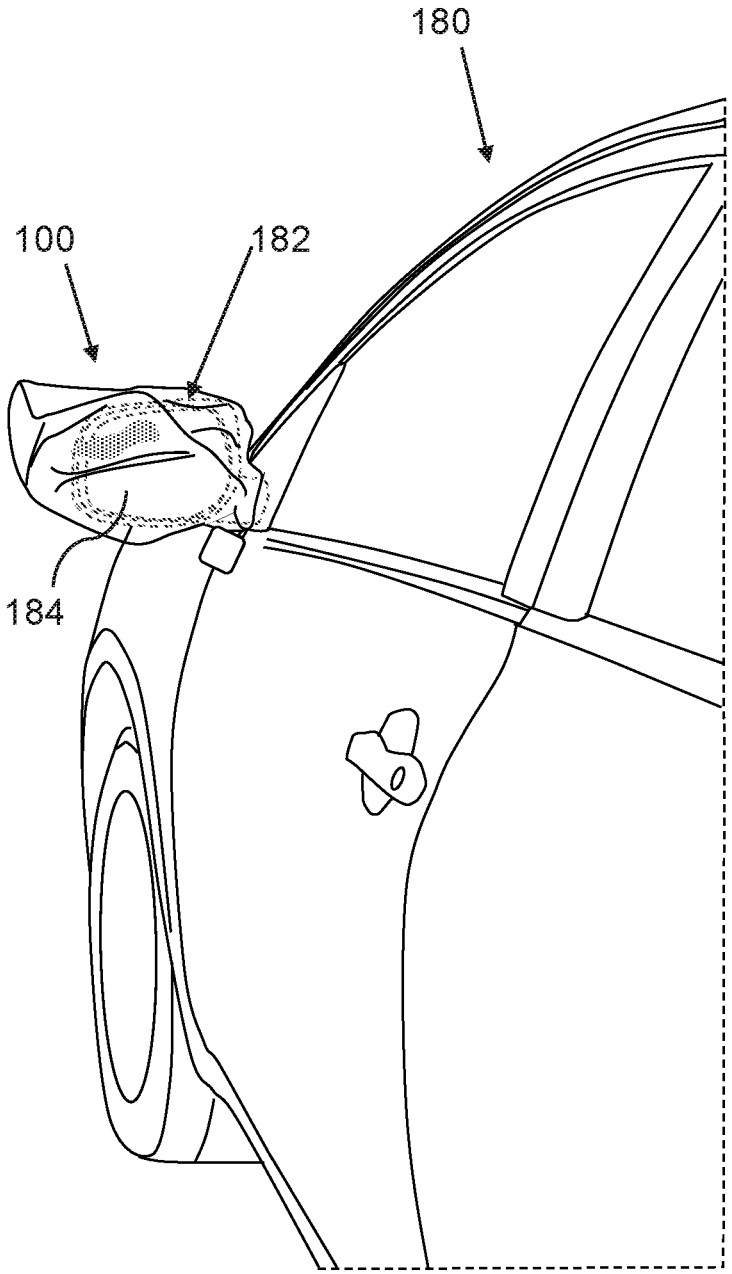
FIG. 2 is a perspective view of a side mirror antitheft device, which is installed on a side mirror of a vehicle, according to an embodiment of the invention.
Figure 3:
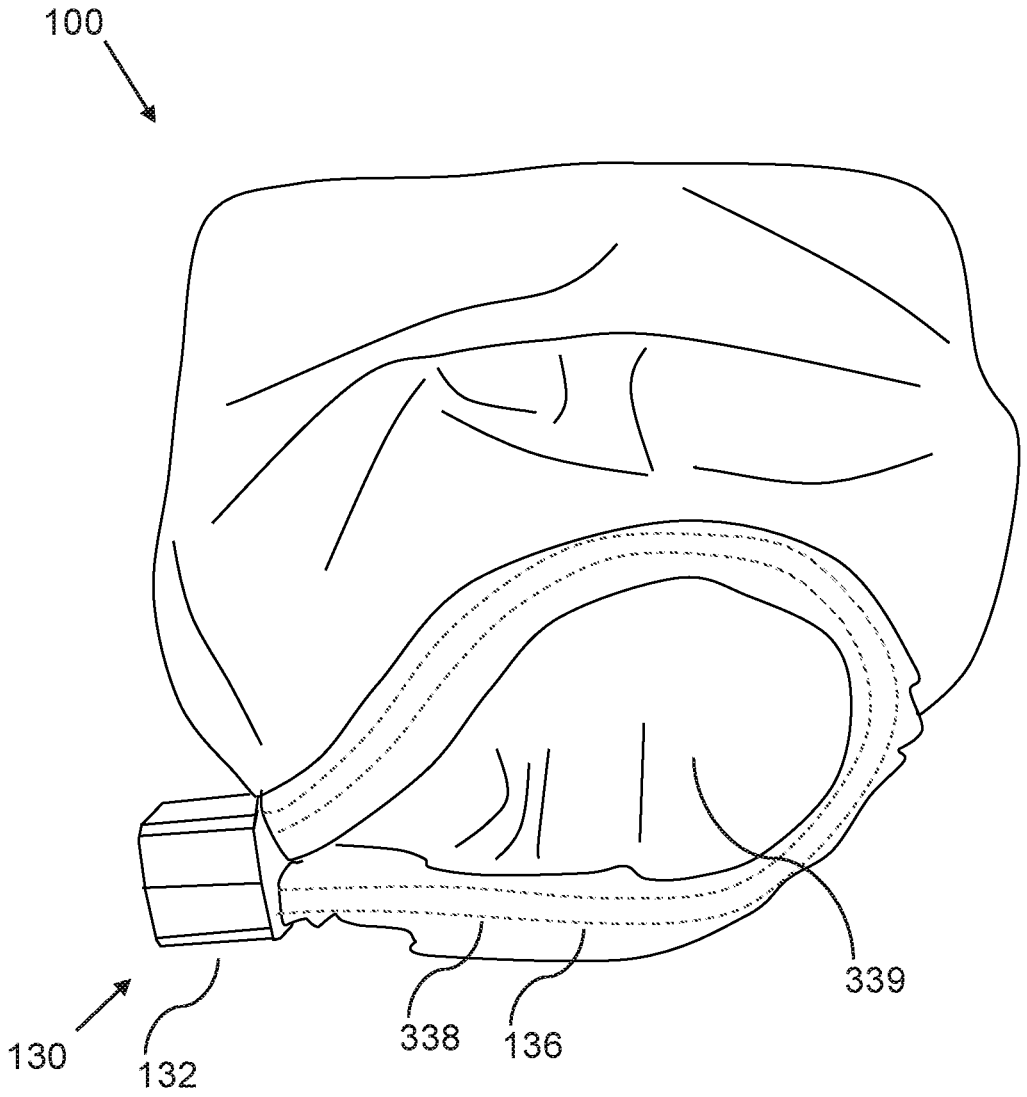
FIG. 3 is a perspective view of a side mirror antitheft device in a locked configuration, according to an embodiment of the invention.

In an embodiment, as shown in FIG. 1, a side mirror antitheft device 100, also called PROKEVLOCK™ 100, can include:

a) a lock bag 110, which can be made from a cut-resistant material 113, wherein the lock bag 110 can include:

i. a bag portion 112, which is configured such that it can be put over a side mirror 182 of a vehicle 180; and ii. a cable guide 114, which can be mounted to an outer periphery of the bag portion along an opening to the interior of the bag portion, such that the cable guide can be:

1. a continuous tube 114 (also called a hem 114 or casing 114; for example, formed by folding and sewing the outer ends of the material used for the bag portion); or 2. a plurality of reinforced holes in the cut-resistant material 113 or guide segments, which allows a lock cable 136 of a cable lock 130 to be laced through the plurality of holes or guide segments; and b) a cable lock 130, which can include:

i. a lock body 132, which for example can be locked and unlocked with a key 134 or other locking mechanism;

ii. a lock cable 136, which can be releasably lockable onto the lock body 132, such that the cable lock 130 and lock cable 136 form a closed loop 338 with a loop opening 339, when the cable lock 130 is locked, as shown in FIG. 3; and iii. a key 134, which is configured to lock and unlock the lock body 132, to secure and release the lock cable 136;

wherein the lock cable 136 protrudes through the cable guide, such that the cable lock 130 is attached to the lock bag 110;

such that the lock body 132 can be positioned (i.e. is positionable) over a side mirror 182 of a vehicle 180, with the side mirror inside an interior of the bag portion, when the side mirror antitheft device 100 is unlocked, such that a bag opening to an interior of the bag portion 112 is maximized, as shown in FIG. 1; and such that the side mirror antitheft device 100 is secured in position on the side mirror 182, such that the lock cable 636 is locked around a stem 186 of the side mirror 182 with the stem 186 protruding through the loop opening 339, such that the loop opening 339 is too small to allow removal of the antitheft device 100, thereby preventing theft of the mirror portion 184 of the side mirror 182, when the side mirror antitheft device 100 is locked onto the side mirror 182, as shown in FIG. 2. FIG. 3 shows the side mirror antitheft device 100 in a locked configuration.

In related embodiments, the cut-resistant material 113, can be a metal mesh or chainmail material, a KEVLAR™ composite, a high-performance polyethylene material, a weave of steelfibre or fiberglass, and can for example include:

a) KEVLAR™ fabric, i.e. a fabric made from Poly-paraphenylene terephthalamide, including KEVLAR™ fabrics reinforced with carbon fiber;

b) CTU-TEX PRO™;

c) CUTLON 3130™;

d) HEXARMOR SUPERFABRIC™;

e) Ultra-high-molecular-weight polyethylene (UHMWPE);

f) A combination of UHMWPE, polyester and fiberglass;

g) A combination of these; and/or h) Other anti-cut or cut-resistant fabric materials.

Figure 5:
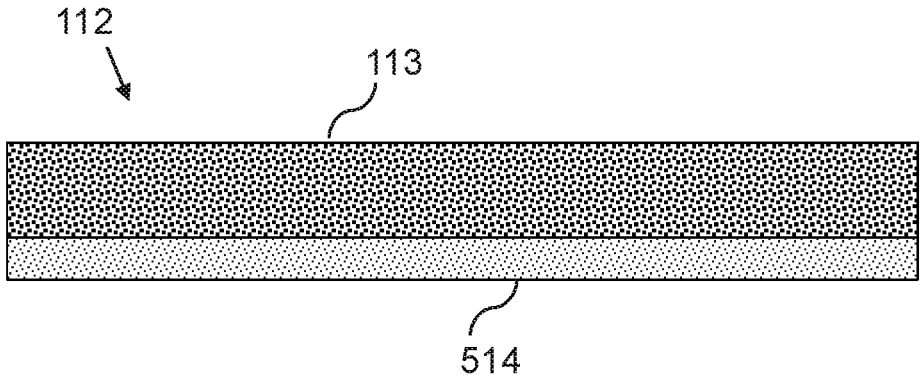
FIG. 5 is a schematic view of a cut-resistant material with an inner lining, according to an embodiment of the invention.

In a related embodiment, as shown in FIG. 5, an inner side of the bag portion 112 can include an inner lining 514 made of a relatively soft material, which is softer than the cut-resistant material 113, in order to protect the side mirror 182 from being scratched by the bag portion 112, particularly if the cut-resistant material 113 is a hard material such as a stainless steel fabric or chainmail. The inner lining 514 can for example be a soft fabric that is glued or sewed onto the inner side, or can be made from a rubber material, for example in the form of a rubber layer 514 or rubber coating 514 that is applied to, such as glued or fused onto, the inner side.

In other related embodiments, the cable lock 130 can be any high strength cable lock, for example made of high-strength steel, such as PYTHON™, keyed, or combination cable locks from MASTER LOCK™, or any other cable lock from other manufacturers. The lock cable 136 can be permanently secured to the lock body 132 in a first end of the lock cable 136, such that a second end of the lock cable 136 is releasably lockable to the lock body 132. Alternatively, first and second ends of the lock cable 136 can include respectively first and second loops, such that the lock body 132 is a pad lock 132, such that the lock cable 136 is locked closed with the pad lock 132.

Figure 4A:
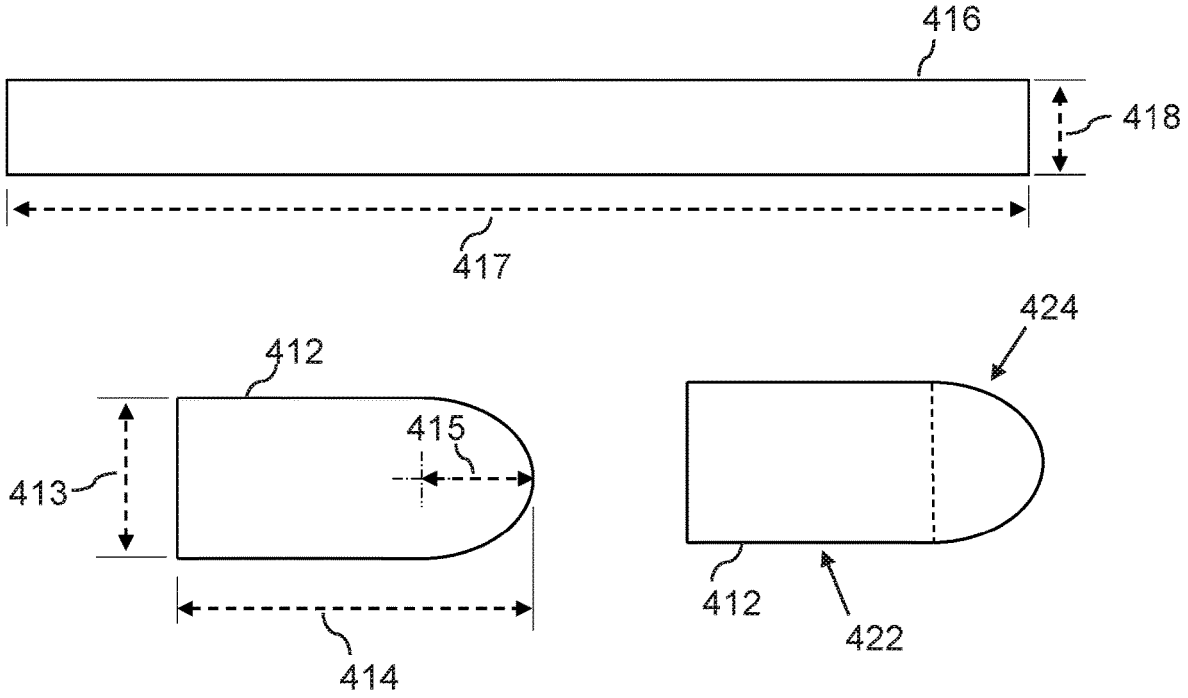
FIG. 4A is a top view of parts of a lock bag of a side mirror antitheft device, prior to assembly, according to an embodiment of the invention.
Figure 4B:
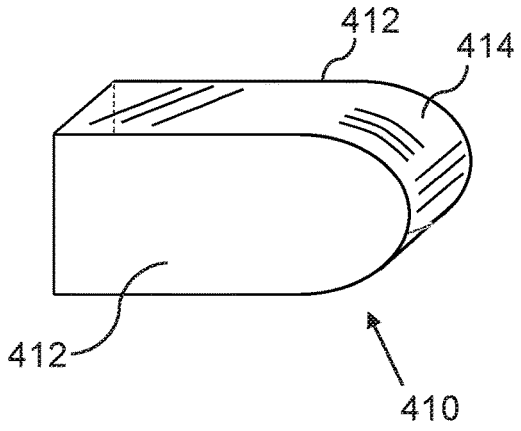
FIG. 4B is a perspective view of a lock bag that is assembled from the parts shown in FIG. 4A, according to an embodiment of the invention.

In a related embodiment, as shown in FIGS. 4A and 4B, a lock bag 410 can be manufactured from center portion 416, which is connected (such as sewn, glued, or fused) between two side portions 412. As shown, the center portion 416 can be an elongated rectangular piece, for example with a center length 417 of 38 inches and a width 418 of 5 inches. The first and second side portions 412 can each include a front rectangular piece 422 connected with a rear curved section 424, which can be half circle, half ellipsoid, or half parabolic curve; for example with a front length 414 of 18 inches and a height 413 of 9 inches of the front rectangular piece 422, and a center radius 415 of the rear curved section of 6 inches. Alternatively, the center portion 416 can have a center length 417 of 30-46 inches and a width 418 of 2-8 inches, and the first and second side portions 412 each can have a front rectangular piece with a front length 414 of 12-24 inches and a height 413 of 6-12 inches, and a center radius 415 of the rear curved section of 3-9 inches.

Figure 6A:
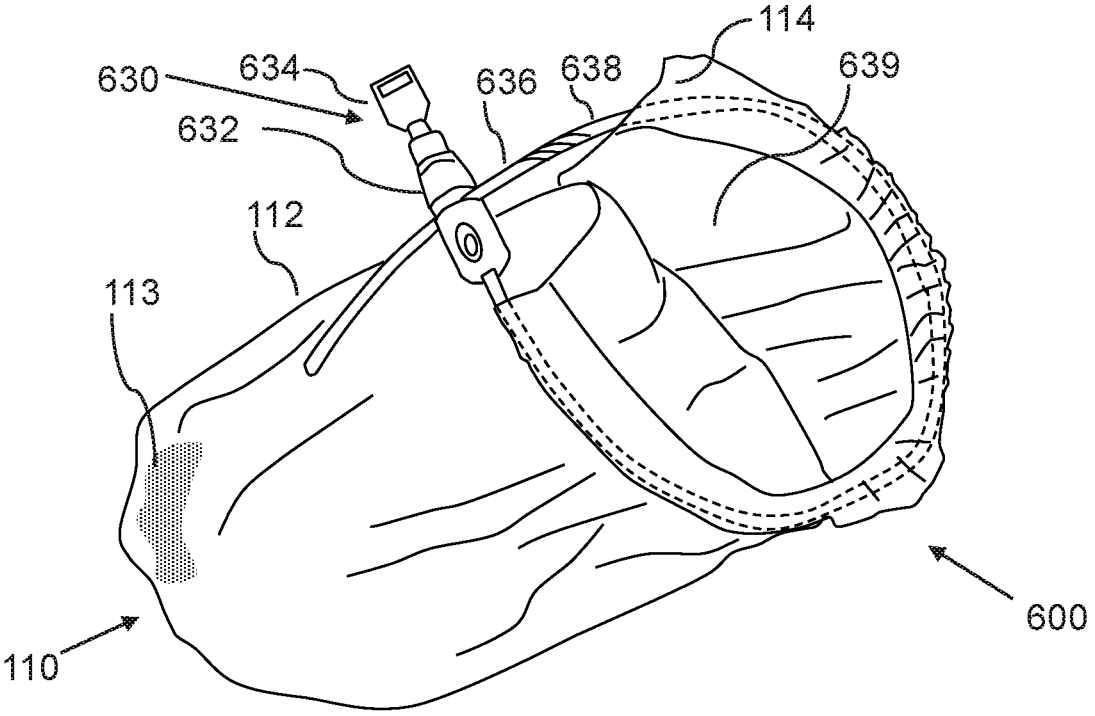
FIG. 6A is a perspective view of an antitheft device in an open configuration, according to an embodiment of the invention.
Figure 6B:
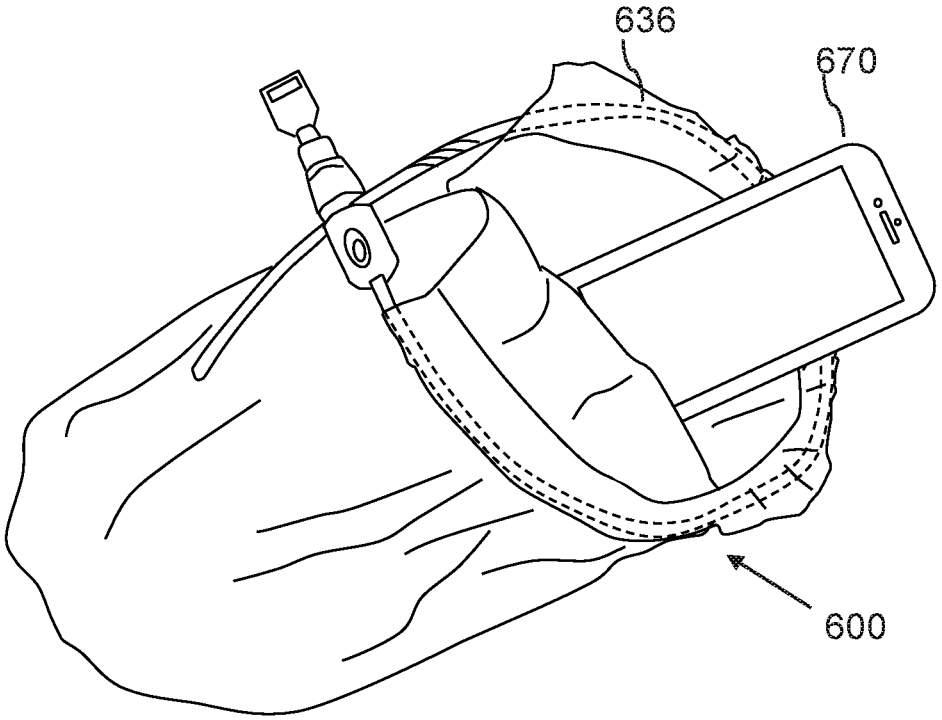
FIG. 6B is a perspective view of an antitheft device in an open configuration with an object partially inserted, according to an embodiment of the invention.
Figure 6C:
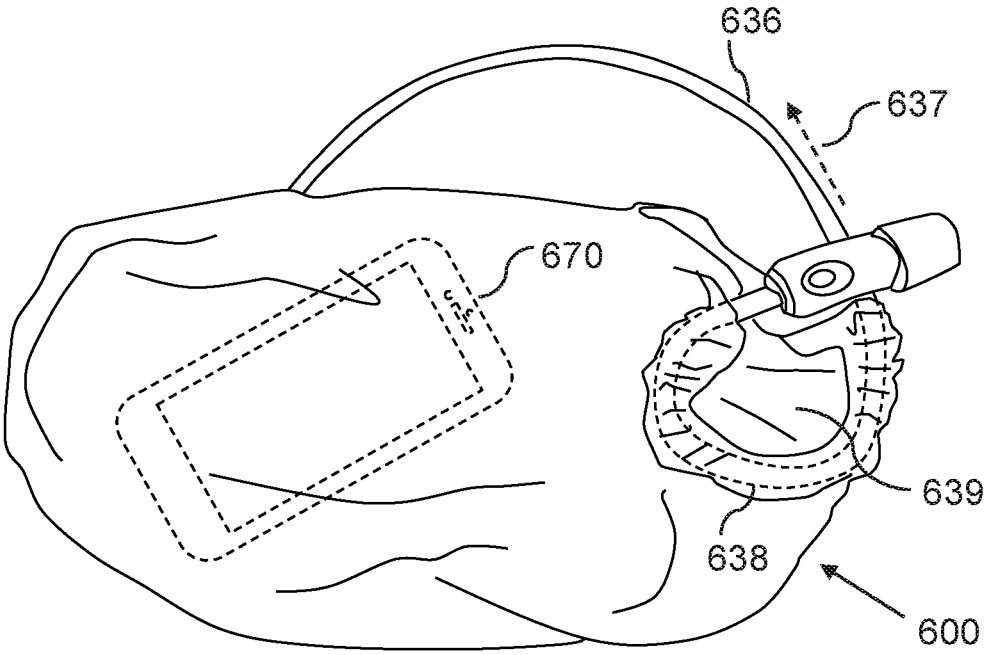
FIG. 6C is a perspective view of an antitheft device in a locked configuration with an object in an interior of the antitheft device, according to an embodiment of the invention.
Figure 6D:
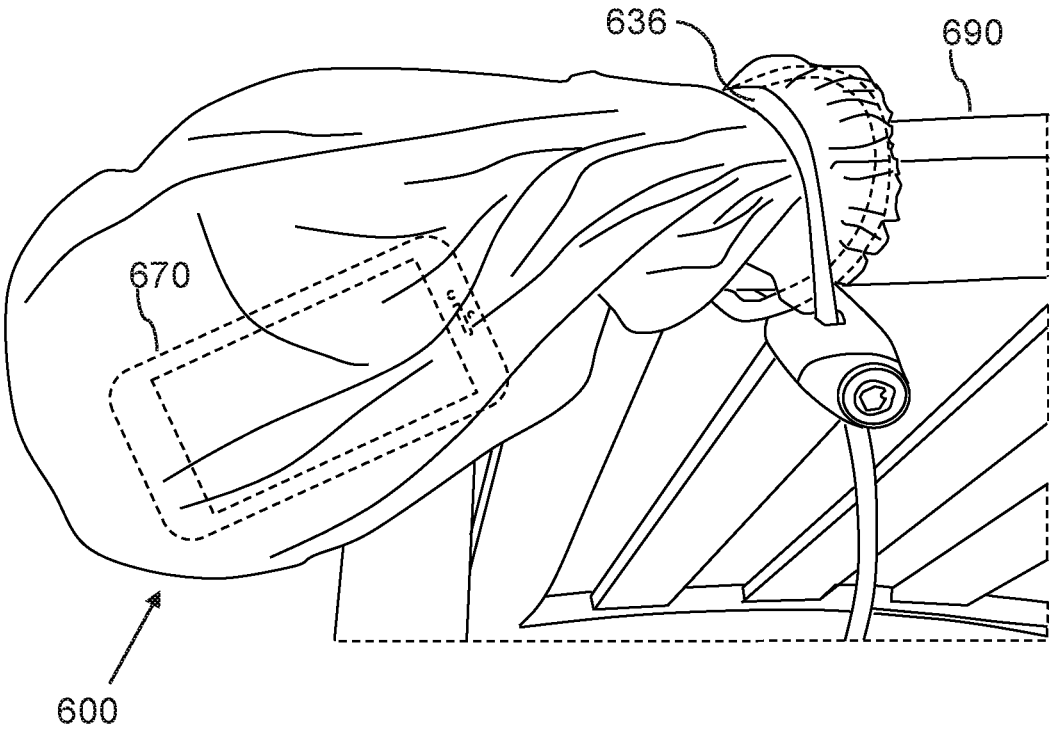
FIG. 6D is a perspective view of an antitheft device in a locked configuration and attached to a mounting structure, with an object in an interior of the antitheft device, according to an embodiment of the invention.

In another embodiment, as shown in FIGS. 6A, 6B, 6C, and 6D, an antitheft device 600, can include:

a) a lock bag 110, which can be made from a cut-resistant material 113, wherein the lock bag 110 can include:

i. a bag portion 112, which is configured to contain an object 670; and ii. a cable guide 114, which can be mounted to an outer periphery of the bag portion along an opening to the interior of the bag portion, such that the cable guide can be:

1. a continuous tube 114 (also called a hem 114 or casing 114; for example, formed by folding and sewing the outer ends of the material used for the bag portion); or 2. a plurality of reinforced holes in the cut-resistant material 113 or guide segments, which allows a lock cable 636 of a cable lock 630 to be laced through the plurality of holes or guide segments; and b) a cable lock 630, which can include:

i. a lock body 632, which for example can be locked and unlocked with a key 634 or other locking mechanism;

ii. a lock cable 636, which can be releasably lockable onto the lock body 632, such that the lock body 632 and lock cable 636 form a closed loop 638 with a loop opening 639, when the cable lock 630 is locked; and iii. a key 634, which is configured to lock and unlock the lock body 632, to secure and release the lock cable 636;

wherein the lock cable 636 protrudes through the cable guide, such that the cable lock 630 is attached to the lock bag 110;

whereby an object 670, such as a mobile device 670 or key, etc., can be positioned in an interior of the lock bag 110, when the side mirror antitheft device 100 is unlocked, as shown in FIGS. 6A and 6B; and whereby the antitheft device 600 can be secured in position (i.e. is securable in position) with the lock cable 636 securely attached to a mounting structure 690, such as a pool chair 690, rail, or other structure, for example such that the lock cable 636 is wrapped around the mounting structure 690 or penetrates through the mounting structure 690, and with the lock bag 110 closed with the object 670 locked in the interior of the lock bag 110, thereby preventing theft of the object 670, when the antitheft device 600 is closed tight and locked onto the mounting structure 690, as shown in FIGS. 6C and 6D. FIG. 6D shows that the lock cable 636 can be wrapped an extra turn around the mounting structure 690.

In a related embodiment, as shown in FIGS. 6A, 6B, 6C, and 6D, the cable lock 630 can be configured such that the lock cable 636 protrudes through the lock body 632, such that the lock cable 636 can be tightened 637 and locked with a minimal loop opening 639, by pulling on an outer end of the lock cable 636, such that the object is locked inside the bag portion 112 and cannot be removed via the minimal loop opening 639.

Thus, in related embodiments, the antitheft device 100, 600 can be used to secure personal objects 670 at public places, such as at a public pool or at the beach, and the antitheft device 100, 600 can be used to prevent theft of a mirror portion 184 of a side mirror 182 of a vehicle 180.

Here has thus been described a multitude of embodiments of the antitheft device 100, 600, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A safety storage system, comprising:
a) a safety case, which comprises:
a case body, comprising a front opening and a case interior, which is accessible via the front opening;
wherein the case interior is configured to contain a handgun, such that the handgun is insertable into the case interior via the front opening; and
b) an antitheft bag, comprising:
a lock bag, which is made from a cut-resistant material, wherein the lock bag comprises:
a bag portion, which is configured to contain the safety case, wherein the bag portion comprises:
a center portion;
a first side portion; and
a second side portion, wherein the center portion is connected between the first and second side portions
wherein the center portion is an elongated rectangular piece and the first and second side portions each include a front rectangular piece and a rear curved section, such that the rear curved section is connected to a rear of the front rectangular piece; and
wherein the center portion has a center length in a range of 30-46 inches and a width in a range of 2-8 inches, and the front rectangular piece has a front length in a range of 12-24 inches and a height in a range of 6-12 inches, and the rear curved section has a center radius in a range of 3-9 inches; and
a cable guide, which is mounted to an outer periphery of the bag portion, along a bag opening to an interior of the bag portion; and
a cable lock, which comprises:
a lock body; and
a lock cable, which is releasably lockable to the lock body;
wherein the lock cable protrudes through the cable guide, such that the cable lock is attached to the lock bag;
wherein the cable lock is configured to be locked tight on the lock bag, such that the lock bag is locked closed;
such that the safety case is configured to be locked inside the lock bag with the cable lock, with the handgun inside the safety case; whereby the handgun is safely storable in the safety storage system.

2. The safety storage system of claim 1, wherein the safety case further comprises:
a case lid, which is hingedly connected on a front of the case body;
such that the case lid is configured to close access to the front opening of the case interior, when the case lid is in a closed configuration, and
such that the case lid is configured to provide access to the front opening of the case interior, when the case lid is in an open configuration.

3. The safety storage system of claim 2, wherein the case lid is made from a flexible material, and wherein an upper part of the case lid is connected to an upper part of a front of the case body, such that the case lid is configured with a flexible hinge.

4. The safety storage system of claim 1, wherein the case body comprises:
a) a top wall;
b) a bottom wall; and
c) a side wall, which is curved in a u-shape, such that the top wall is connected to an upper inside of the side wall and the bottom wall is connected to a lower inside of the side wall;
such that the case interior with the front opening is formed between the top wall, the bottom wall, and the side wall.

5. The safety storage system of claim 1, wherein the cable guide is a continuous tube.

6. The safety storage system of claim 1, wherein the cable lock further comprises a key, wherein the key is configured to lock and unlock the lock body.

7. The safety storage system of claim 1, wherein the cut-resistant material is a fabric made from poly-paraphenylene terephthalamide.

8. The safety storage system of claim 7, wherein the fabric is reinforced with carbon fiber.

9. The safety storage system of claim 1, wherein the lock bag further comprises a lining on an inner side of the bag portion.

10. The safety storage system of claim 9, wherein the lining is made from a rubber material.

11. The safety storage system of claim 10, wherein the lining is a rubber coating that is applied to the inner side of the bag portion.

12. A safety storage system, comprising:

a) a safety case, which comprises:

a case body, comprising a front opening and a case interior, which is accessible via the front opening;

wherein the case interior is configured to contain a handgun, such that the handgun is insertable into the case interior via the front opening; and b) an antitheft bag, comprising:

a lock bag, which is made from a cut-resistant material, wherein the lock bag comprises:

a bag portion, which is configured to contain the safety case, wherein the bag portion comprises:

a center portion;

a first side portion; and a second side portion, wherein the center portion is connected between the first and second side portions wherein the center portion is an elongated rectangular piece and the first and second side portions each include a front rectangular piece and a rear curved section, such that the rear curved section is connected to a rear of the front rectangular piece; and wherein the center portion has a center length in a range of 30-46 inches and a width in a range of 2-8 inches, and the front rectangular piece has a front length in a range of 12-24 inches and a height in a range of 6-12 inches, and the rear curved section has a center radius in a range of 3-9 inches; and a cable lock, which comprises:

a lock body; and a lock cable, which is releasably lockable to the lock body;

wherein the lock cable is attached to an outer periphery of the bag portion, along a bag opening to an interior of the bag portion;

wherein the cable lock is configured to be locked tight on the lock bag, such that the lock bag is locked closed such that the safety case is configured to be locked inside the lock bag with the cable lock, with the handgun inside the safety case; whereby the handgun is safely storable in the safety storage system.

13. The safety storage system of claim 12, wherein the safety case further comprises:

a case lid, which is hingedly connected on a front of the case body;

such that the case lid is configured to close access to the front opening of the case interior, when the case lid is in a closed configuration, and such that the case lid is configured to provide access to the front opening of the case interior, when the case lid is in an open configuration.

14. The safety storage system of claim 13, wherein the case lid is made from a flexible material, and wherein an upper part of the case lid is connected to an upper part of a front of the case body, such that the case lid is configured with a flexible hinge.

15. The safety storage system of claim 12, wherein the lock bag further comprises:

a cable guide, which is mounted to the outer periphery of the bag portion, along the bag opening to the interior of the bag portion;

wherein the lock cable protrudes through the cable guide, such that the cable lock is attached to the lock bag.

16. The safety storage system of claim 15, wherein the cable guide is a continuous tube.

17. A safety storage system, comprising:

a) a safety case, which comprises:

a case body, comprising a front opening and a case interior, which is accessible via the front opening;

wherein the case interior is configured to contain a handgun, such that the handgun is insertable into the case interior via the front opening; and b) an antitheft bag, comprising:

a lock bag, which is made from a cut-resistant material, wherein the lock bag comprises:

a bag portion, which is configured to contain the safety case, wherein the bag portion comprises:

a center portion;

a first side portion; and a second side portion, wherein the center portion is connected between the first and second side portions wherein the center portion is an elongated rectangular piece and the first and second side portions each include a front rectangular piece and a rear curved section, such that the rear curved section is connected to a rear of the front rectangular piece; and wherein the center portion has a center length in a range of 30-46 inches and a width in a range of 2-8 inches, and the front rectangular piece has a front length in a range of 12-24 inches and a height in a range of 6-12 inches, and the rear curved section has a center radius in a range of 3-9 inches; and a bag lock, wherein the bag lock is configured to be attached to the lock bag, such that the bag lock is configured to be locked tight on the lock bag, such that the lock bag is locked closed;

such that the safety case is configured to be locked inside the lock bag with the cable lock, with the handgun inside the safety case; whereby the handgun is safely storable in the safety storage system.

* * * * *